US005194017A

United States Patent [19]

Consoli

[11] Patent Number: 5,194,017

[45] Date of Patent: Mar. 16, 1993

[54] CONNECTOR FOR A FLEXIBLE CIRCUIT

[75] Inventor: John J. Consoli, Harrisburg, Pa.

[73] Assignee: AMP Incorporated, Harrisburg, Pa.

[21] Appl. No.: 846,296

[22] Filed: Feb. 24, 1992

[51] Int. Cl.[5] ..... H01R 13/00

[52] U.S. Cl. ..... 439/492

[58] Field of Search ..... 439/59, 60, 61, 62, 439/67, 76, 77, 492–499, 569, 570, 876, 217, 224

[56] References Cited

U.S. PATENT DOCUMENTS

| | | | |
|---|---|---|---|
| 3,366,919 | 1/1968 | Gammel, Sr. et al. | 439/495 |
| 3,848,946 | 11/1974 | Halley et al. | 439/495 |
| 4,169,641 | 10/1979 | Olsson | 339/17 F |
| 4,172,626 | 10/1979 | Olsson | 339/17 F |
| 4,181,386 | 1/1980 | Olsson | 359/17 F |
| 4,252,389 | 2/1981 | Olsson | 339/17 F |
| 4,367,006 | 1/1983 | Rehbogen, Jr. et al. | 339/176 MF |
| 4,379,608 | 4/1983 | Olsson et al. | 339/75 MP |
| 4,634,195 | 1/1987 | Shoemaker | 339/17 F |
| 4,639,063 | 1/1987 | Mueller | 339/75 M |
| 4,640,562 | 2/1987 | Shoemaker | 339/17 F |
| 4,818,239 | 4/1989 | Erk | 439/569 |
| 4,911,659 | 3/1990 | Viselli | 439/570 |
| 4,969,840 | 11/1990 | Ii | 439/495 |

*Primary Examiner*—Joseph H. McGlynn

[57] ABSTRACT

An electrical connector 1 for a flexible circuit 2 comprises, a housing 3 constructed on a first housing part 4 and a second housing part 5, between which is defined a circuit receiving opening 6 extending along the first housing part 4 for receiving the flexible circuit 2 against a row of conductive electrical contacts 7 spaced apart on centerlines corresponding to circuit traces 8 on the flexible circuit 2, and mounting feet 9 inserted into openings 52 in either of two positions for mounting the first housing part 4 to a circuit board 10 in first position or an inverted position, and to obstruct the first housing part 4 from movement.

18 Claims, 7 Drawing Sheets

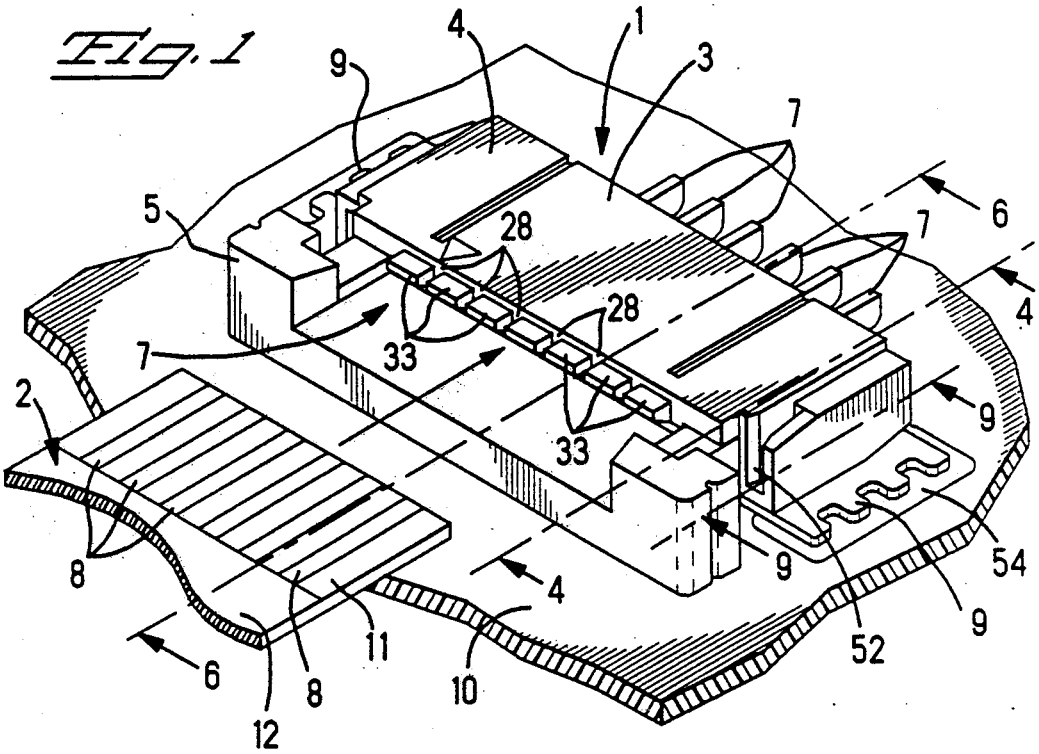
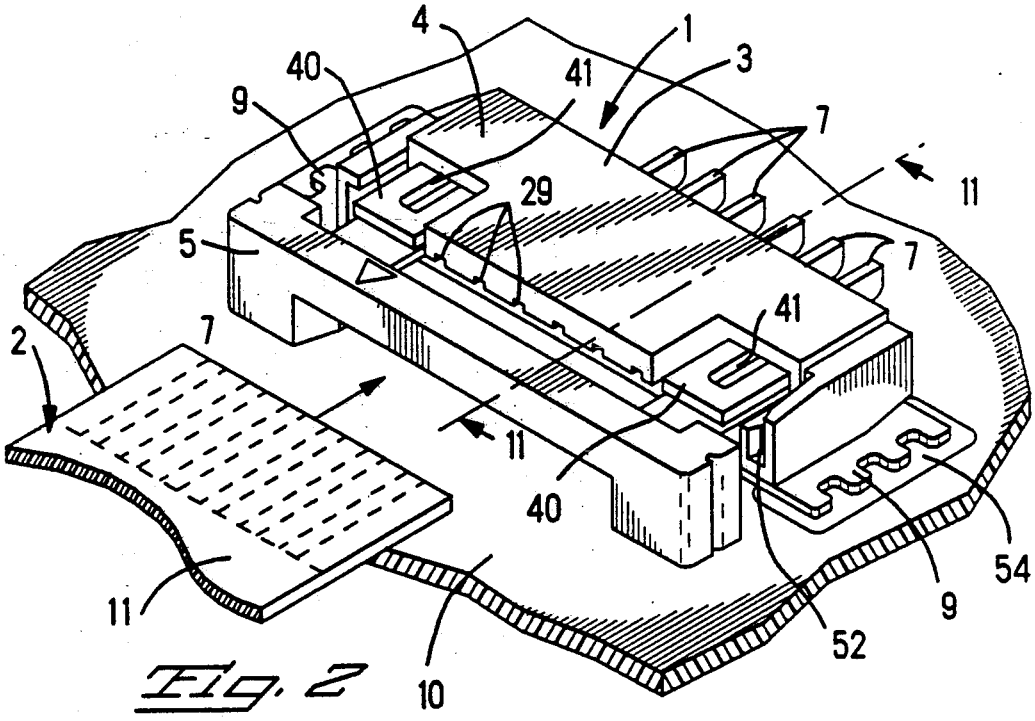
Fig. 2

CONNECTOR FOR A FLEXIBLE CIRCUIT

FIELD OF THE INVENTION

A connector for mounting on a circuit board and useful for interconnecting a flexible circuit to the circuit board.

BACKGROUND OF THE INVENTION

A flexible circuit comprises, electrical circuit traces of thin paths of metal adhered to a flexible strip of dielectric material. The flexible circuit is useful for connecting between multiple electronic components that are assembled together in the construction of an electronic apparatus such as a computer or an electrical appliance. The multiple electronic components are compactly assembled in confined spaces within the apparatus to achieve an apparatus of compact size. Between the compactly assembled electronic components are awkwardly arranged, confined spaces within which an electrical circuit is to be located for interconnecting the components. A flexible circuit is ideal for this purpose. The flexible circuit is thin, on the order of 0.011 inches (0.28 mm.), so as to extend in such confined spaces between the multiple electronic components. The flexible circuit is readily deflected into flexible curves, so as to extend along awkwardly arranged spaces among the electronic components.

SUMMARY OF THE INVENTION

The invention resides in a connector of small size for electrical connection to a flexible circuit having multiple circuits spaced apart on 1 mm. centerline spacing.

The invention further resides in a connector of two parts that telescope together for assembly onto a flexible circuit, wherein the same parts of the connector are adapted for assembly on a circuit board upside down, meaning, inverted.

The invention further resides in a connector for assembly onto a flexible circuit wherein mounting feet of the connector are assembled to a housing from opposite directions to obstruct movement of the housing in opposite directions.

According to the invention, an electrical connector for a flexible circuit comprises, a housing, a circuit receiving opening in the housing for receiving a flexible circuit against a row of conductive electrical contacts spaced apart on centerlines corresponding to circuit traces on a flexible circuit, and mounting feet for mounting the first housing part to a circuit board, the mounting feet being received in respective slit like receptacles of the first housing part, the respective slit like receptacles having feet receiving openings facing in opposite directions.

The invention will now be described by way of example with reference to the drawings, in which:

DESCRIPTION OF THE DRAWINGS

FIG. 1 is a fragmentary perspective view of an electrical connector for a flexible circuit illustrated with a circuit board and a portion of a flexible circuit;

FIG. 2 is view similar to FIG. 1 illustrating the electrical connector and the flexible circuit inverted;

FIG. 13 is a plan view of contacts for the connector shown in FIGS. 1 and 2.

Figure 3:
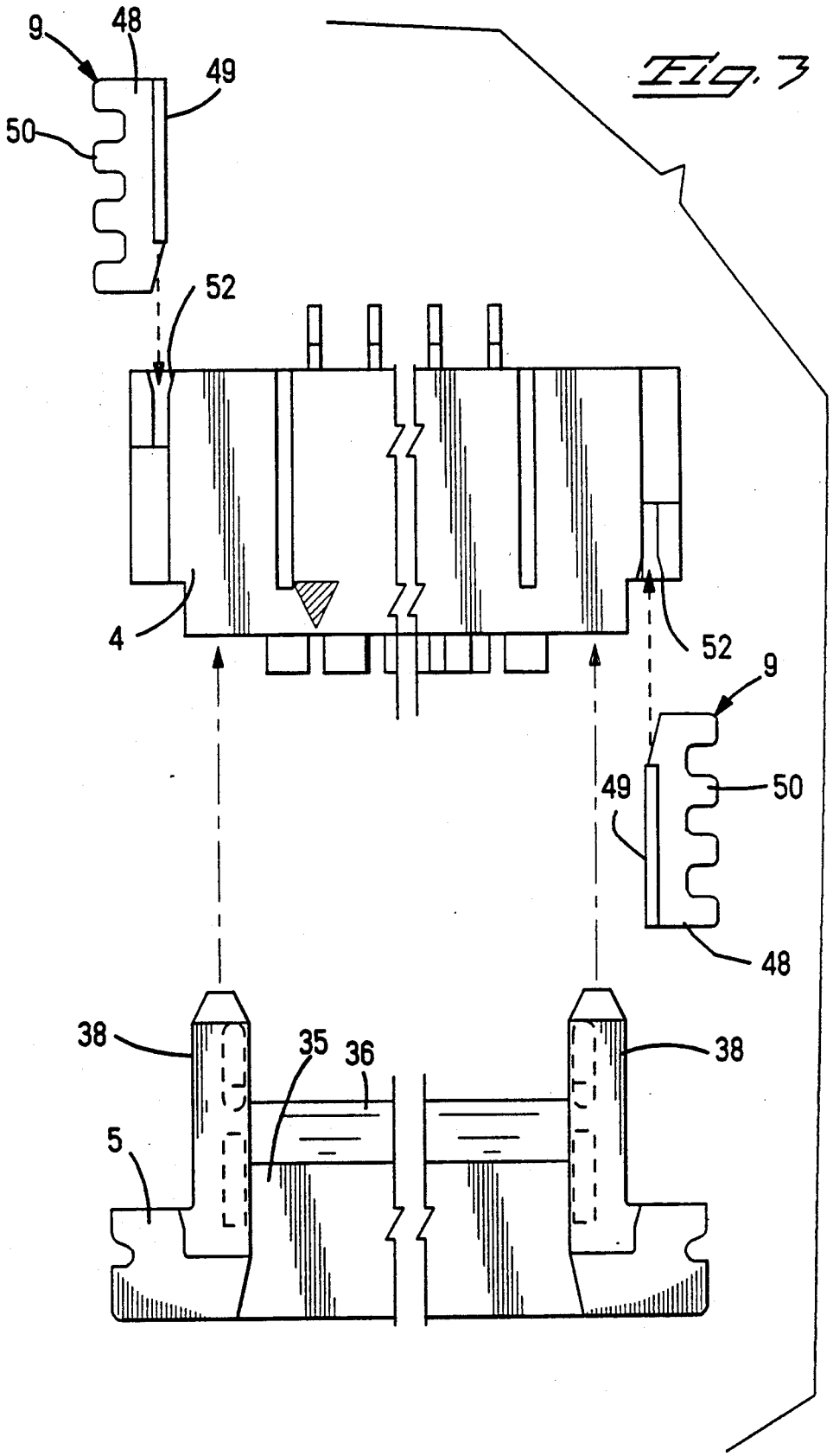
FIG. 3 is a plan view with parts exploded apart of the connector of FIG. 1.
Figure 4:
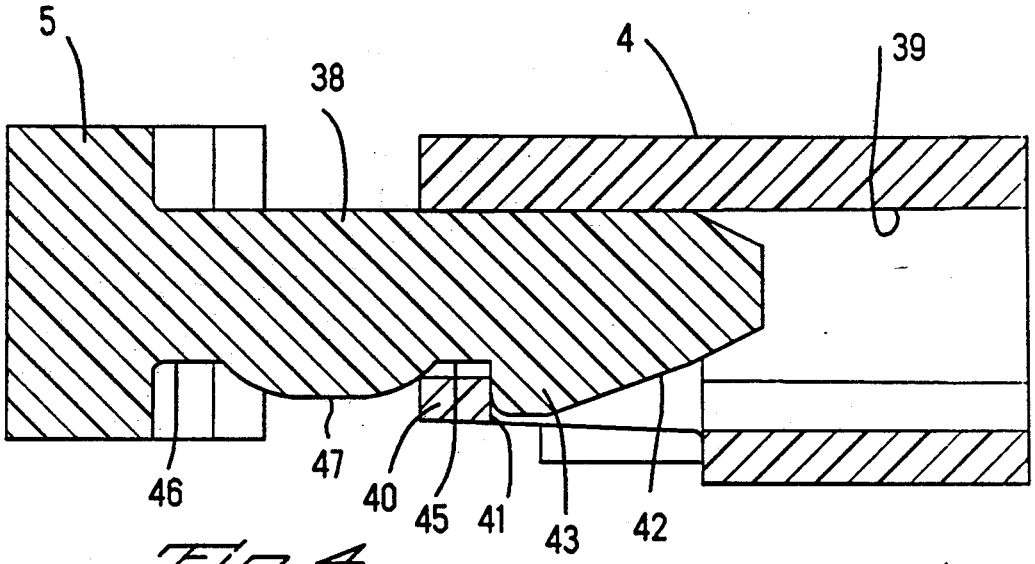
FIG. 4 is an enlarged fragmentary section view taken along line 4—4 of FIG. 1, and illustrating parts of the connector assembled part way.
Figure 5:
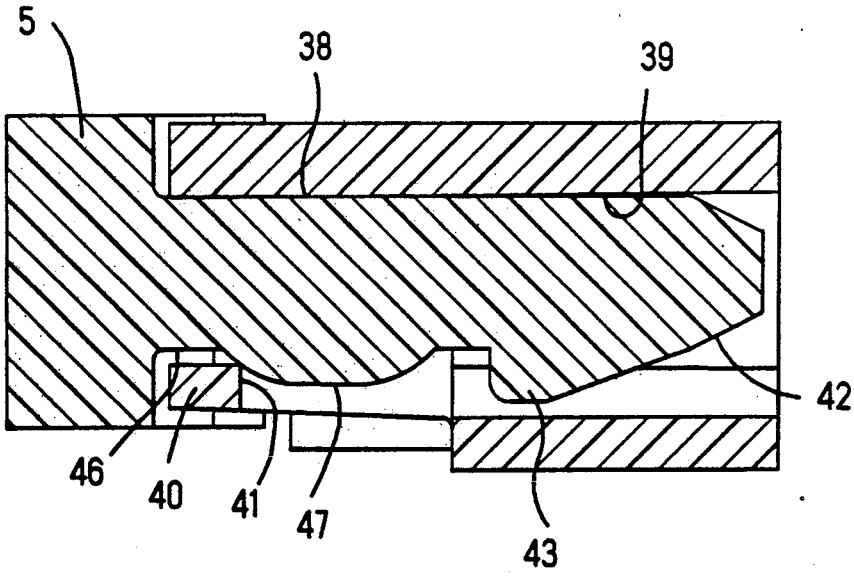
FIG. 5 is a view similar to FIG. 4, with parts fully assembled.

With reference to the drawings, an electrical connector 1 for a flexible circuit 2 comprises, a housing 3 constructed of a first housing part 4 and a second housing part 5, between which is defined a circuit receiving opening 6 extending along the first housing part 4 for receiving the flexible circuit 2 against a row of conductive electrical contacts 7 spaced apart on centerlines corresponding to circuit traces 8 on the flexible circuit 2, and mounting feet 9 for mounting the first housing part 4 to a circuit board 10.

Figure 11:
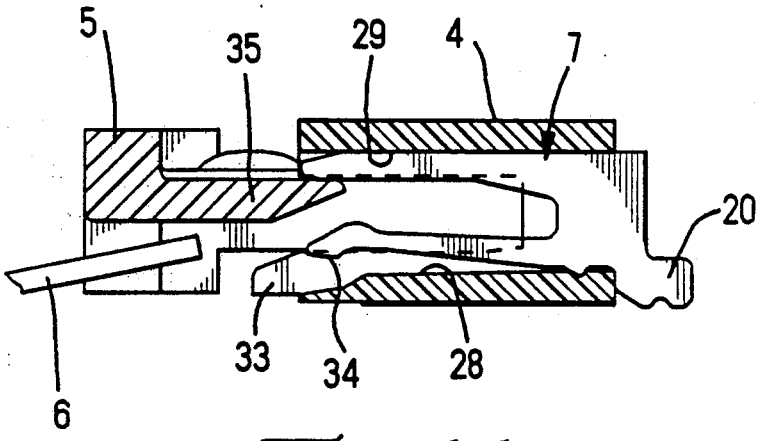
FIG. 11 is a section view of the connector taken along the line 11—11 of FIG. 2.

The flexible circuit 2 is constructed with the circuit traces 8 on, for example, 1 mm. centerline spacing. The circuit traces 8 are on a flexible dielectric strip 11, and are covered by a thin insulative coating 12. The circuit traces 8 and the strip 11 protrude from the coating 12. When the circuit 2 is received in the circuit receiving opening 6, the second housing part 5 is moveable from a position, FIG. 6, to a position, FIG. 7, to urge the traces 8 of the circuit 2 into engagement with the contacts 7. FIG. 1 shows the housing 3 mounted in a first position to receive the circuit traces 8 of the flexible circuit 2 facing away from the circuit board 10. Sometimes the circuit traces 8 face toward the circuit board 10, FIG. 2, which requires the connector 1 to be mounted in an inverted position, FIG. 2. The connector 1 is adapted for mounting in a position, FIG. 2, inverted with respect to the position of the connector 1 shown in FIG. 1, using the same parts of the connector 1 for mounting in either of the positions. The construction of the contacts 7 will now be described. As shown in FIG. 13, each contact 7 is stamped from a planar metal strip integrally along a carrier strip 13. Each contact 7 is of unitary flat construction with a resilient, first contact arm 14 and a second contact arm 15 projecting from a bight 16, to form a U shaped contact 7 with an opening 17 between the contact arms 14, 15 at a front of the contact 7. At a rear end 18, a first terminal 19 projects for mounting the contact 7 on the circuit board 10 in a first position, FIG. 1. The rear end 18 has a second terminal 20 for mounting the contact 7 on the circuit board 10 in a second position, FIG. 2, inverted with respect to the first position. The terminals 19, 20 and the contact arms 14, 15 and the bight 16 are in a common plane of thickness. The terminals 19, 20 project from a rear end 21, FIGS. 6 and 11, of the first housing part 4, and overlap the rear end 21 to limit forward movement of the contacts 7 relative to the first housing part 4.

One of the terminals 19, 20 remains on each of the contacts 7 prior to mounting the contact 7 on the circuit board 10 to predetermine the shape of the contact 7 for mounting solely in a selected one of the first and second positions. When the first terminal 19 is to remain, FIG. 13, the contact 7 is severed from the shaded portion 22 of the carrier strip 13. The contact 7 thus severed is used to mount the connector 1 in the first position, FIGS. 1, 6 and 7. When it is desired to mount the connector 1 in an inverted position, FIGS. 2 and 11, the contact 7, FIG. 13, is severed to remove the shaded portion 23 corresponding to the first terminal 19. The contact 7 is severed from the carrier strip 13 along the line 24, to form the second terminal 20 remaining on the contact 7 to mount the contact 7 in an inverted position, FIGS. 2 and 11. Each terminal 19, 20 has a mounting surface 25, with scalloped shaped projections and with recesses therein to collect solder used for forming a solder joint of the terminals 19, 20 to the circuit board 10. The mounting surface 25 is in the thickness of the flat contact 7 and faces in a direction perpendicular to the rear end 18 of the contact 7.

The second terminal 20 has two alternative shapes that are formed by stamping. One of the shapes, FIG. 13, is formed by removal from the contact 7 of the shaded area 26 representing the first terminal 19, and by severing along the line 27 to form the rear facing mounting surface 25, facing in the same direction as the rear end 18 of the contact 7. This terminal 20 is used to mount the connector 1 in a third position, not shown, with the rear ends 18 of the contacts 7 facing toward the circuit board 10, and the circuit receiving opening 6 facing away from the circuit board 10.

As shown in FIGS. 1, 2, 6 and 7, the contacts 7 are mounted in grooves 28, 29 recessed in opposite side walls 30, 31 defining the circuit receiving opening 6. The contact arms 15 are supported against the side wall 31. The bights 16 have raised locking projections 32 that register in the side wall 30 to lock the contacts 7 in place. A funnel tapered entrance of the opening 6 at the side wall 30 is formed by inwardly tapering partitions 33 beside the contact receiving grooves 28. The contact arms 14 have raised ridges 34 that register slidably between the partitions 33 to support the resilient contact arms 14 laterally to prevent the contacts 7 from buckling during resilient deflection, FIG. 7, when the second housing part 5 is moved from its position of FIG. 6 to a position of FIG. 7. The grooves 28 are deeply recessed to permit movement therein of the ridges 34 during deflection of the resilient contact arms 14.

Figure 6:
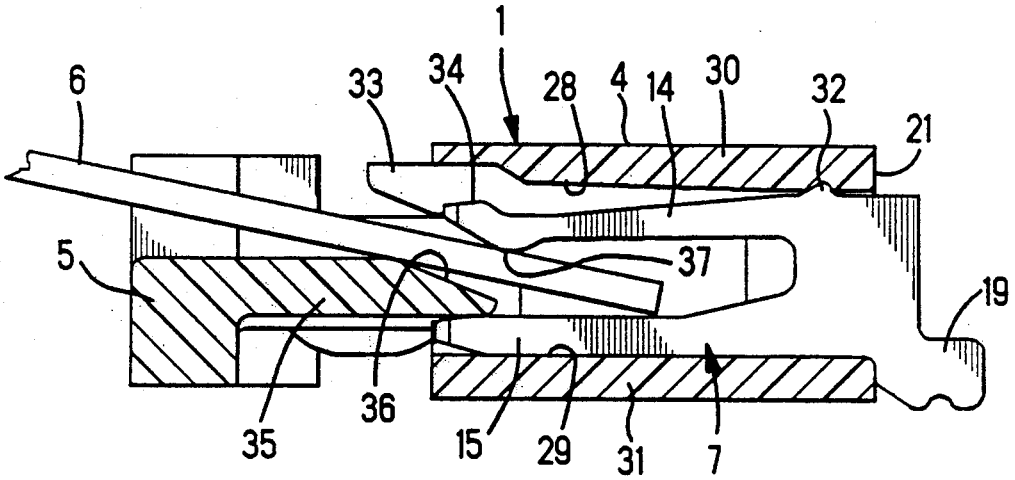
FIG. 6 is a section view of the connector taken along the line 6—6 of FIG. 1.
Figure 7:
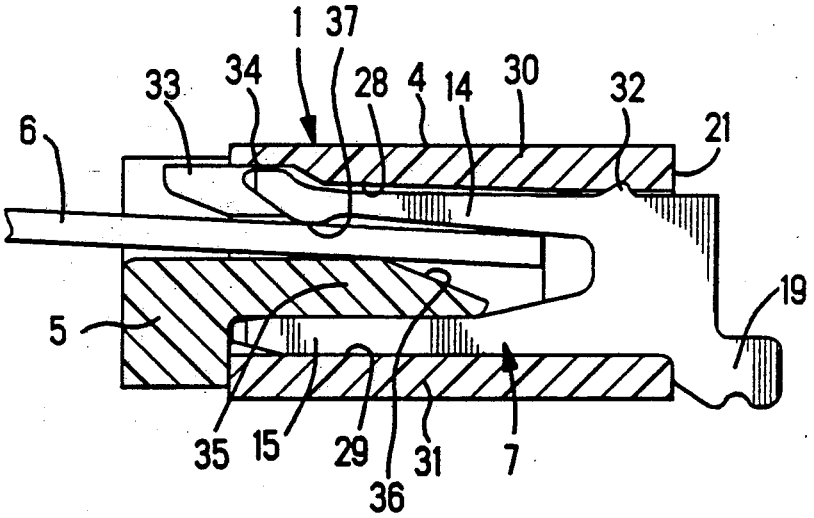
FIG. 7 is a view similar to FIG. 6 illustrating connection of the connector with the flexible circuit.

A tongue 35, FIG. 6, of the second housing part 5 has an inclined leading edge 36 facing the resilient contact arms 14. The circuit 2 is inserted into the circuit receiving opening 6 between the tongue 36 and the resilient contact arms 14, 15. The circuit 2 is also between the two contact arms 14, 15. The resilient contact arms 14 each have projecting contact surfaces 37 facing toward the other contact arms 15 that engage the circuit traces 8 for electrical connection therewith. When the tongue 35 is inserted between the contact arms 14, 15, no deflection of the contact arms 14 occurs. For example, the flexible circuit 2 is about 0.28 mm. thick. When the tongue 35 and the circuit 2 are inserted between the contact arms 14, 15 the resilient contact arms 14 are deflected, FIG. 7, a distance corresponding to the thickness of the flexible circuit 2.

With reference to FIGS. 3–7, the second housing part 5 has alignment posts 38 projecting toward, and in alignment with, post receiving cavities 39 of the first housing part 4. The cavities 39 are flanked by resilient flaps 40, FIG. 2, with closed end slots 41 in the flaps 40. The posts 38, FIGS. 4 and 5, have tapered tips 42 in front of laterally projecting latches 43 with rear facing walls 44 and two spaced, front and rear detents 45, 46 separated by a smoothly bulged projection 47.

The second housing part 5 is assembled by forcing the tapered tips 42 past leading edges of the flaps 40 and into the cavities 39, until the latches 43 register in respective closed end slots 41 to hold the second housing part 5 inserted part way in the first housing part 4. The leading edges of the flaps 40 register in the front detents 45. The rear facing walls 44 will impinge against the ends of the slots 41 to prevent withdrawal of the second housing part 5. For full insertion of the second housing part 5, the projections 47 are forced over the leading edges of the flaps 40. The projections 47 register in the slots 41.

Figure 8:
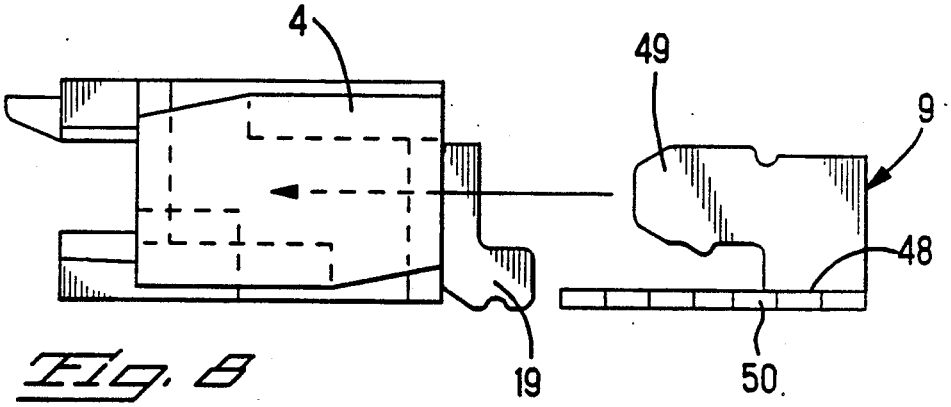
FIG. 8 is a side view of the connector as shown in FIG. 3, illustrating alternate assembly of a mounting foot.
Figure 9:
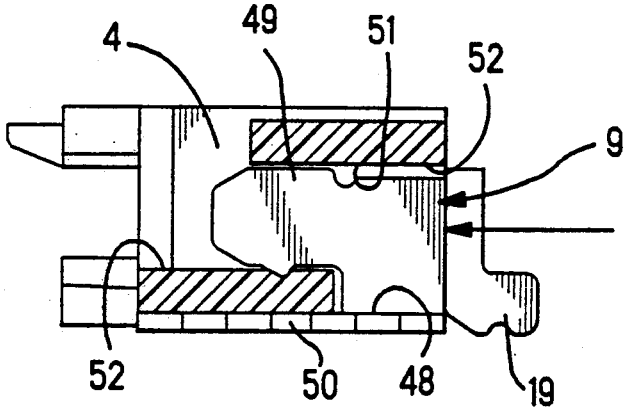
FIG. 9 is a section view taken along the line 9—9 of FIG. 1.
Figure 10:
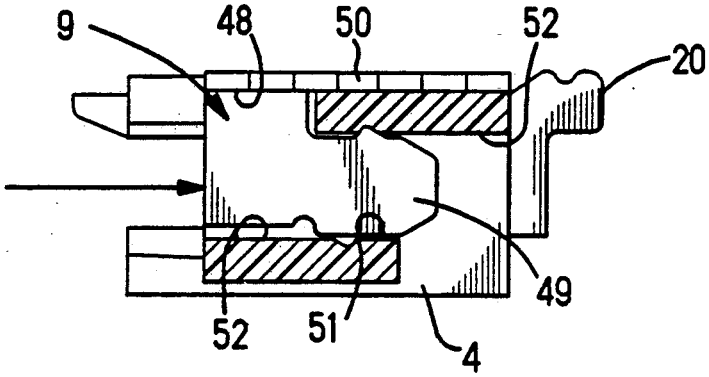
FIG. 10 is a view similar to FIG. 9, illustrating inverted assembly of a mounting foot.

With reference to FIGS. 3, 8 and 9, the mounting feet 9 will be described. Each of the mounting feet 9 is of unitary metal strip construction, formed with a relatively broad portion 48 and a relatively narrow portion 49. The relatively narrow portions 49 comprise the thicknesses of the mounting feet 9. Each of the mounting feet 9 is bent at an angle, to extend the relatively broad portion 48 bent out of the plane of the relatively narrow portion 49. Each of the broad portions 48 is flat and is adapted for surface mounting on the circuit board 10. Each of the broad portions 48 has an edge 50 with scalloped shaped projections and with recesses therein to collect solder used for attachment to the circuit board. Each of the relatively narrow portions 49 is received in respective slit like receptacles 51 of the first housing part 4, FIGS. 1, 2 and 3. Ends of the respective slit like receptacles 51 have feet receiving openings 52 facing front and rear, in opposite directions. The mounting feet 9 are inserted in opposite directions, front and rear, such that the mounting feet 9 project, one to the front, and one to the rear, in opposite directions. When the mounting feet 9 are connected to the circuit board 10, they obstruct the first housing part 4 from movement in opposite directions.

Figure 12:
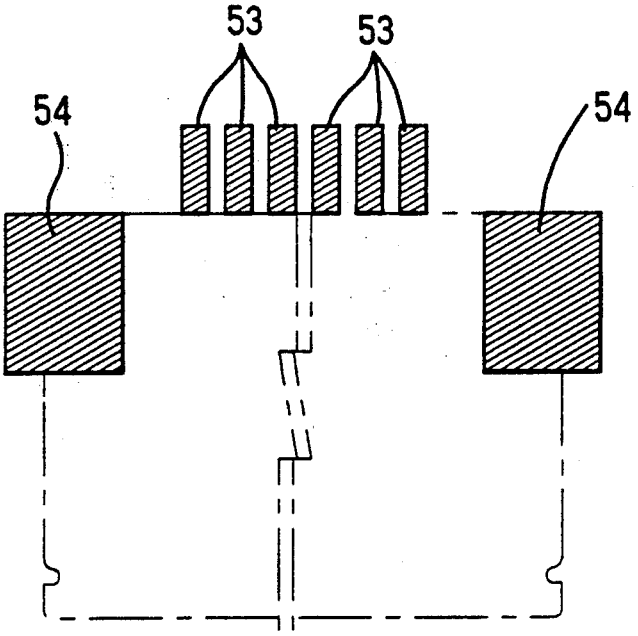
FIG. 12 is a plan view of a portion of the circuit board shown in FIG. 1.
Figure 17:
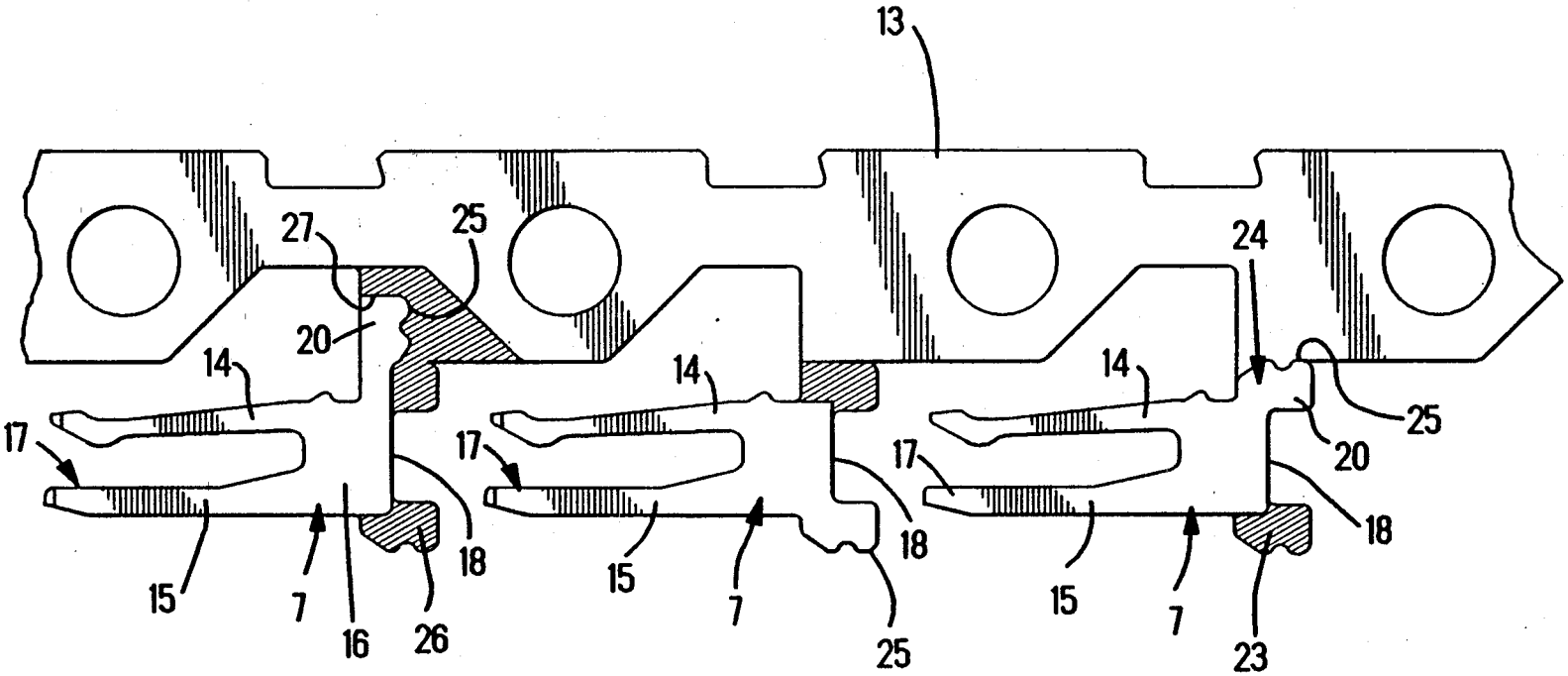

FIG. 12 illustrates conductive areas 53, 54 on the circuit board 10, comprising a footprint to which the contacts 7 and the mounting feet 9 are connected by solder to surface mount them to the circuit board 10. A row of six, for example, conductive areas 53, to which a terminal 19 or terminal 20 can be secured, are offset from two conductive areas 54, so as to overlap one of the mounting feet 9 inserted in either one of two opposite directions in a corresponding one of the receptacles 51.

I claim:

1. An electrical connector for a flexible circuit comprising: a housing including a first housing part, a circuit receiving opening in the housing for receiving a flexible circuit against a row of conductive electrical contacts spaced apart on centerlines corresponding to circuit traces on a flexible circuit, mounting feet received in respective slit like receptacles of the first housing part, the respective slit like receptacles having feet receiving openings facing in opposite directions from which to project the mounting feet for obstructing the first housing part from movement in opposite directions, and broad portions on the mounting feet, each of the broad portions having an edge with recesses therein to collect solder for attachment to a circuit board.

2. An electrical connector as recited in claim 1, wherein, the housing includes a moveable housing part moveable to urge an electrical circuit received in the circuit receiving opening into engagement with the contacts.

3. An electrical connector as recited in claim 1, wherein, for each of the mounting feet the relatively broad portion is bent out of a plane defined by a relatively narrow portion.

4. An electrical connector as recited in claim 1, wherein, each of the contacts comprises, a terminal projecting from the housing for attachment to a circuit board.

5. An electrical connector as recited in claim 1, wherein, a resiliently deflectable contact arm of each of the contacts extends along the circuit receiving opening and has a projecting ridge aligned by a groove in the housing, and the groove is deeply recessed to permit movement therein of the ridge during deflection of the resilient contact arm.

6. An electrical connector for a flexible circuit comprising: a housing including a first housing part, a circuit receiving opening in the housing for receiving a flexible circuit against a row of conductive electrical contacts spaced apart on centerlines corresponding to circuit traces on a flexible circuit, mounting feet received in respective slit like receptacles of the first housing part, the respective slit like receptacles having feet receiving openings facing in opposite directions from which to project the mounting feet for obstructing the first housing part from movement in opposite directions, and each of the contacts having two terminals for mounting the contacts on a circuit board in either a first position or a second position inverted with respect to the first position.

7. An electrical connector as recited in claim 6, wherein, one of the terminals remains on each of the contacts prior to mounting each of the contacts on a circuit board to predetermine the contact for mounting solely in a selected one of the first and second positions.

8. An electrical connector as recited in claim 6, wherein, each of the contacts is integral with the two terminals in a common plane of thickness of the contact.

9. An electrical connector for a flexible circuit, comprising: a housing having a circuit receiving opening, slit like receptacles of the housing having feet receiving openings facing in opposite directions, mounting feet for receipt in a first one of the feet receiving openings for mounting the first housing part in a first position on a circuit board, and being received alternatively in a second of the feet receiving openings in an inverted position for mounting the first housing part in a second position, the second position being inverted relative to the first position, and electrical contacts in the housing for contacting circuit traces of an electrical circuit inserted in the cable receiving opening.

10. An electrical connector as recited in claim 9, wherein, the housing includes a moveable housing part moveable to urge an electrical circuit received in the circuit receiving opening into engagement with the contacts.

11. An electrical connector as recited in claim 9, wherein, each of the contacts comprises, a terminal projecting from the housing for attachment to a circuit board.

12. An electrical connector as recited in claim 9, wherein, a resiliently deflectable contact arm of each of the contacts extends along the circuit receiving opening and has a projecting ridge aligned by a groove in the housing, and the groove is deeply recessed to permit movement therein of the ridge during deflection of the resilient contact arm.

13. An electrical connector as recited in claim 9, wherein, for each of the mounting feet a relatively broad portion is bent out of the plane of a relatively narrow portion.

14. An electrical connector as recited in claim 13, wherein, each of the broad portions of the mounting feet has an edge with recesses therein to collect solder for attachment to a circuit board.

15. An electrical connector as recited in claim 13, wherein, the relatively narrow portions comprise thicknesses of the mounting feet.

16. An electrical connector as recited in claim 9, and further comprising: each of the contacts having two terminals for mounting the contacts on a circuit board in either a first position or a second position inverted with respect to the first position.

17. An electrical connector as recited in claim 16, wherein, one of the terminals remains on each of the contacts prior to mounting the contacts on a circuit board to predetermine the contact for mounting solely in a selected one of the first and second positions.

18. An electrical connector as recited in claim 16, wherein, the contact is integral with the two terminals in a common plane of thickness of the contact.

* * * * *